US011271346B2

(12) United States Patent
Chiang

(10) Patent No.: US 11,271,346 B2
(45) Date of Patent: Mar. 8, 2022

(54) PLUG CONNECTOR WITH CONNECTOR POSITION ASSURANCE ELEMENT AND CONNECTOR ASSEMBLY INCLUDING THE SAME

(71) Applicant: Cheng Uei Precision Industry Co., LTD., New Taipei (TW)

(72) Inventor: Chih-Hsien Chiang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/134,127

(22) Filed: Dec. 24, 2020

(65) Prior Publication Data

US 2021/0281011 A1 Sep. 9, 2021

(30) Foreign Application Priority Data

Mar. 6, 2020 (CN) ..... CN202020271411

(51) Int. Cl.
*H01R 13/627* (2006.01)
*H01R 13/502* (2006.01)
*H01R 13/432* (2006.01)

(52) U.S. Cl.
CPC ..... *H01R 13/6272* (2013.01); *H01R 13/502* (2013.01); *H01R 13/432* (2013.01)

(58) Field of Classification Search
CPC H01R 13/6272; H01R 13/502; H01R 13/432; H01R 4/185; H01R 13/639; H01R 13/641
See application file for complete search history.

(56) References Cited

U.S. PATENT DOCUMENTS

| | | | | |
|---|---|---|---|---|
| 6,939,159 | B1 * | 9/2005 | Klein | H01R 13/6272 439/352 |
| 9,350,116 | B1 * | 5/2016 | Morello | H01R 13/639 |
| 9,653,846 | B1 * | 5/2017 | Caldwell | H01R 13/62955 |
| 10,340,632 | B1 * | 7/2019 | Rangi | H01R 13/6275 |
| 10,355,414 | B1 * | 7/2019 | Alvarado | H01R 13/6272 |
| 2008/0064260 | A1 * | 3/2008 | Mckenzie | H01R 13/639 439/587 |
| 2017/0077646 | A1 * | 3/2017 | Kim | H01R 13/639 |
| 2017/0170602 | A1 * | 6/2017 | Matsumoto | H01R 13/639 |
| 2019/0288452 | A1 * | 9/2019 | Lord | H01R 13/641 |

(Continued)

*Primary Examiner* — Abdullah A Riyami
*Assistant Examiner* — Nelson R. Burgos-Guntin
(74) *Attorney, Agent, or Firm* — Cheng-Ju Chiang

(57) ABSTRACT

A connector assembly includes a socket connector, and a plug connector with connector position assurance element inserted into the socket connector. The plug connector with connector position assurance element includes an insulating body, a plurality of terminals, a plurality of cables and a connector position assurance element. The insulating body defines a plurality of terminal slots. The plurality of the terminals are assembled in the plurality of the terminal slots. Two opposite ends of each terminal have a connecting end and a fitting end. The connecting ends of the plurality of the terminals are connected to the plurality of the cables. The connector position assurance element is inserted to a top of the insulating body, and then a plug-in status between the plug connector with connector position assurance element, and the socket connector is maintained.

20 Claims, 13 Drawing Sheets

(56) References Cited

U.S. PATENT DOCUMENTS

| | | | | |
|---|---|---|---|---|
| 2019/0319390 | A1* | 10/2019 | Damodharan | H01R 13/4365 |
| 2020/0059030 | A1* | 2/2020 | Duan | H01R 13/428 |
| 2020/0127408 | A1* | 4/2020 | Jabrane | H01R 13/6272 |
| 2020/0136311 | A1* | 4/2020 | Narama | H01R 13/6272 |
| 2020/0227857 | A1* | 7/2020 | Kim | H01R 13/4367 |
| 2020/0412052 | A1* | 12/2020 | Menez | H01R 13/639 |
| 2021/0057849 | A1* | 2/2021 | Colarusso | H01R 13/434 |
| 2021/0111519 | A1* | 4/2021 | Schneider | H01R 13/641 |
| 2021/0119379 | A1* | 4/2021 | Narama | H01R 13/641 |
| 2021/0143449 | A1* | 5/2021 | Ohm | H01R 13/62933 |
| 2021/0249819 | A1* | 8/2021 | Son | H01R 13/4361 |
| 2021/0281011 | A1* | 9/2021 | Chiang | H01R 13/502 |
| 2021/0281012 | A1* | 9/2021 | Yang | H01R 13/6581 |
| 2021/0288439 | A1* | 9/2021 | Kamemura | H01R 13/641 |
| 2021/0296820 | A1* | 9/2021 | Gruendler | H01R 13/62955 |
| 2021/0351538 | A1* | 11/2021 | Yamamoto | H01R 13/465 |

* cited by examiner

PLUG CONNECTOR WITH CONNECTOR POSITION ASSURANCE ELEMENT AND CONNECTOR ASSEMBLY INCLUDING THE SAME

CROSS-REFERENCE TO RELATED APPLICATION

The present application is based on, and claims priority from, China Patent Application No. 202020271411.5, filed Mar. 6, 2020, the disclosure of which is hereby incorporated by reference herein in its entirety.

BACKGROUND OF THE INVENTION

1. Field of the Invention

The present invention generally relates to a plug connector, and more particularly to a plug connector with connector position assurance element capable of maintaining a plug-in status between the plug connector with connector position assurance element, and a socket connector, and a connector assembly including the plug connector with connector position assurance element, and the socket connector.

2. The Related Art

A conventional plug connector has a buckling portion that can be buckled to a socket connector, so that the plug connector and the socket connector enter a plug-in status.

However, the above-mentioned connection method is easy to separate the plug connector from the socket connector due to a pressure of an external force.

Therefore, it is necessary to provide an innovative connector assembly, the innovative connector assembly includes a plug connector with connector position assurance element, and a socket connector. The plug connector with connector position assurance element is capable of maintaining a plug-in status between the plug connector with connector position assurance element, and a socket connector.

SUMMARY OF THE INVENTION

An object of the present invention is to provide a plug connector with connector position assurance element which is inserted into and cooperated with a socket connector. Two sides of a surface of the socket connector are recessed inward to form two connecting spaces. The plug connector with connector position assurance element includes an insulating body, a plurality of terminals, a plurality of cables and a connector position assurance element. The insulating body defines a plurality of terminal slots longitudinally penetrating through the insulating body. Two sides of an upper surface of the insulating body protrude upward to form two protruding blocks spaced from each other. Two outer surfaces of the two protruding blocks oppositely protrude outward to form two positioning blocks. The upper surface of the insulating body protrudes upward and then is bent rearward to form a buckling portion projecting into a gap between the two protruding blocks. The two protruding blocks and the buckling portion are spaced from the upper surface of the insulating body to form a positioning space among the two protruding blocks, the buckling portion and the upper surface of the insulating body. The plurality of the terminals are assembled in the plurality of the terminal slots. Two opposite ends of each terminal have a connecting end and a fitting end. The connecting ends of the plurality of the terminals are connected to the plurality of the cables. The connector position assurance element is inserted to a top of the insulating body. The connector position assurance element has a base portion. Two sides of a front surface of the base portion protrude frontward to form two sliding portions. Middles of the two sliding portions define two sliding channels longitudinally extending and transversely penetrating through the middles of the two sliding portions. Each sliding channel has a first positioning hole and a second positioning hole. A middle of the front surface of the base portion extends frontward to form an abutting block located between the two sliding portions. The abutting block is disposed corresponding to the positioning space. When the socket connector and the plug connector with connector position assurance element are disengaged, the two positioning blocks are positioned in the two first positioning holes of the two sliding portions, the abutting block are without entering the positioning space. When the plug connector with connector position assurance element is inserted into the socket connector, the connector position assurance element is pushed forward, the two first positioning holes of the two sliding portions break away from the two positioning blocks in advance, so the connector position assurance element is able to move frontward by virtue of two sliding channels of the two sliding portions passing frontward through the two positioning blocks, and the connector position assurance element is switched to buckle the two positioning blocks in the two second positioning holes of the two sliding portions, at the same time, the abutting block enters the positioning space and abuts upward against the buckling portion, so the positioning space is filled up to make the buckling portion have no way of being pressed down, front ends of the two sliding portions enter the two connecting spaces, and then a plug-in status between the plug connector with connector position assurance element, and the socket connector is maintained.

Another object of the present invention is to provide a plug connector with connector position assurance element inserted into and cooperated with a socket connector. At least one side of a surface of the socket connector is recessed inward to form at least one connecting space. The plug connector with connector position assurance element includes an insulating body, a plurality of terminals and a connector position assurance element. At least one side of an upper surface of the insulating body protrudes upward to form at least one protruding block. An outer surface of the at least one protruding block protrudes outward to form at least one positioning block. The upper surface of the insulating body protrudes upward and then is bent rearward to form a buckling portion projecting to one side of the at least one protruding block. The at least one protruding block and the buckling portion are spaced from the upper surface of the insulating body to form a positioning space among the at least one protruding block, the buckling portion and the upper surface of the insulating body. The plurality of the terminals are assembled in the insulating body. The connector position assurance element is inserted to a top of the insulating body. The connector position assurance element has a base portion. At least one side of a front surface of the base portion protrudes frontward to form at least one sliding portion. A middle of the at least one sliding portion defines at least one sliding channel longitudinally extending and transversely penetrating through the middle of the at least one sliding portion. A front end of the at least one sliding channel expands outward to form at least one first positioning hole. A top and a bottom of a middle of the at least one sliding channel expand outward to form at least one second positioning hole. A middle of the front surface of the base portion extends frontward to form an abutting block located adjacent to one side of the at least one sliding portion. The abutting block is disposed corresponding to the positioning space. When the socket connector and the plug connector with connector position assurance element are disengaged, the at least one positioning block is positioned in the at least one first positioning hole of the at least one sliding portion. The abutting block is without entering the positioning space. When the plug connector with connector position assurance element is inserted into the socket connector, the connector position assurance element is pushed forward, the at least one first positioning hole of the at least one sliding portion breaks away from the at least one positioning block in advance, so the connector position assurance element is able to move frontward by virtue of the at least one sliding channel of the at least one sliding portion passing frontward through the at least one positioning block, and the connector position assurance element is switched to buckle the at least one positioning block in the at least one second positioning hole of the at least one sliding portion, at the same time, the abutting block enters the positioning space and abuts upward against the buckling portion, so the positioning space is filled up to make the buckling portion have no way of being pressed down, a front end of the at least one sliding portion enters the at least one connecting space, and then a plug-in status between the plug connector with connector position assurance element, and the socket connector is maintained.

Another object of the present invention is to provide a connector assembly. The connector assembly includes a socket connector, and a plug connector with connector position assurance element inserted into the socket connector. Two sides of an inner surface of a top wall of the socket connector are recessed inward to form two connecting spaces spaced from each other. The plug connector with connector position assurance element includes an insulating body, a plurality of terminals, a plurality of cables and a connector position assurance element. The insulating body defines a plurality of terminal slots longitudinally penetrating through the insulating body. Two sides of an upper surface of the insulating body protrude upward to form two protruding blocks spaced from each other. Two outer surfaces of the two protruding blocks oppositely protrude outward to form two positioning blocks. The upper surface of the insulating body protrudes upward and then is bent rearward to form a buckling portion projecting into a gap between the two protruding blocks. The two protruding blocks and the buckling portion are spaced from the upper surface of the insulating body to form a positioning space among the two protruding blocks, the buckling portion and the upper surface of the insulating body. The plurality of the terminals are assembled in the plurality of the terminal slots. Two opposite ends of each terminal have a connecting end and a fitting end. The connecting ends of the plurality of the terminals are connected to the plurality of the cables. The connector position assurance element is inserted to a top of the insulating body. The connector position assurance element has a base portion. Two sides of a front surface of the base portion protrude frontward to form two sliding portions. Middles of the two sliding portions define two sliding channels longitudinally extending and transversely penetrating through the middles of the two sliding portions. Each sliding channel has a first positioning hole and a second positioning hole. A middle of the front surface of the base portion extends frontward to form an abutting block located between the two sliding portions. The abutting block is disposed corresponding to the positioning space. When the socket connector and the plug connector with connector position assurance element are disengaged, the two positioning blocks are positioned in the two first positioning holes of the two sliding portions, the abutting block is without entering the positioning space. When the plug connector with connector position assurance element is inserted into the socket connector, the connector position assurance element is pushed forward, the two first positioning holes of the two sliding portions break away from the two positioning blocks in advance, so the connector position assurance element is able to move frontward by virtue of two sliding channels of the two sliding portions passing frontward through the two positioning blocks, and the connector position assurance element is switched to buckle the two positioning blocks in the two second positioning holes of the two sliding portions, at the same time, the abutting block enters the positioning space and abuts upward against the buckling portion, so the positioning space is filled up to make the buckling portion have no way of being pressed down, front ends of the two sliding portions enter the two connecting spaces, and then a plug-in status between the plug connector with connector position assurance element, and the socket connector is maintained.

As described above, the abutting block abuts against the buckling portion by virtue of the connector position assurance element to maintain the plug-in status between the socket connector and the plug connector with connector position assurance element.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
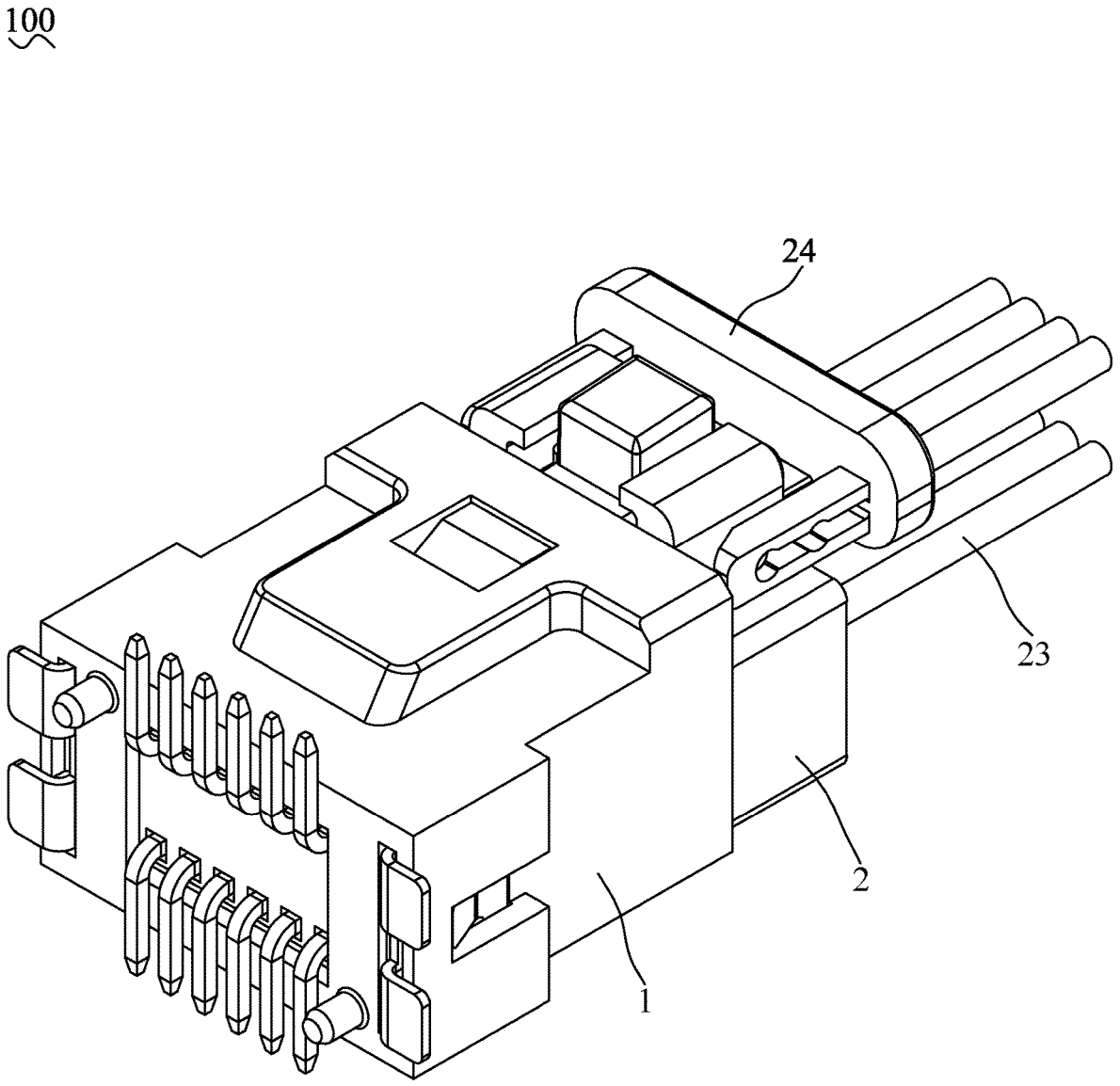
FIG. 1 is a perspective view of a connector assembly in accordance with the present invention, wherein the connector assembly includes a plug connector with connector position assurance element, and a socket connector cooperated with the plug connector with connector position assurance element.
Figure 2:
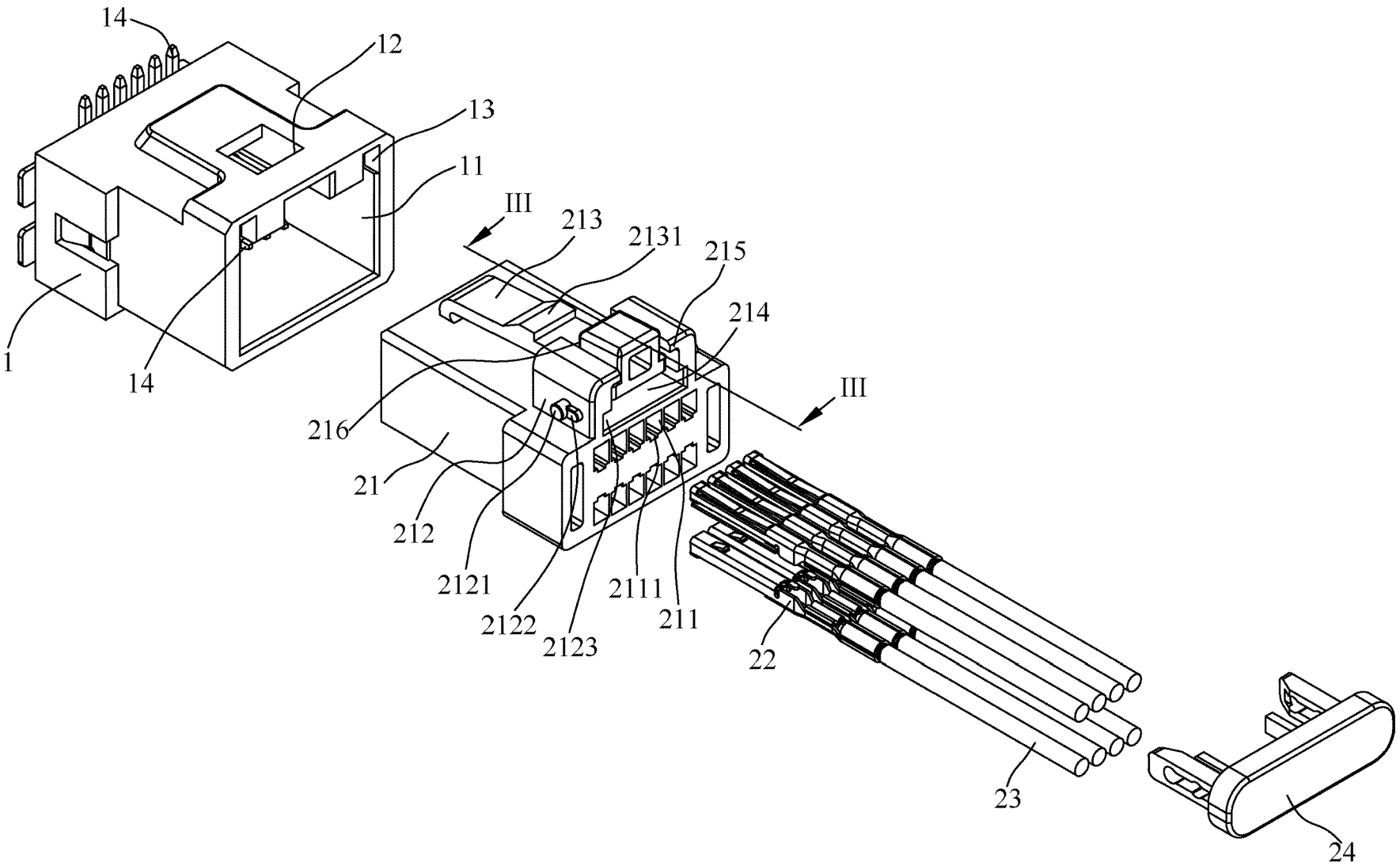
FIG. 2 is an exploded perspective view of the connector assembly of FIG. 1.

With reference to FIG. 1 and FIG. 2, a connector assembly 100 and a plug connector with connector position assurance element 2 with connector position assurance element in accordance with a preferred embodiment of the present invention are shown. The connector assembly 100 includes the plug connector with connector position assurance element 2, and a socket connector 1. The plug connector with connector position assurance element 2 is adapted for being assembled with the socket connector 1. The plug connector with connector position assurance element 2 is inserted into and is cooperated with the socket connector 1.

The socket connector 1 is shown as a hollow shape. The socket connector 1 defines an insertion space 11 penetrating through a rear surface of the socket connector 1. The plug connector with connector position assurance element 2 is inserted into and connected to the insertion space 11 of the socket connector 1. The insertion space 11 of the socket connector 1 is cooperated with the plug connector with connector position assurance element 2. A rear of a top wall of the socket connector 1 defines a buckling hole 12 penetrating through the top wall of the socket connector 1 along an up-down direction. The buckling hole 12 is communicated with the insertion space 11.

At least one side of a surface of the socket connector 1 is recessed inward to form at least one connecting space 13. Two sides of the surface of the socket connector 1 are recessed inward to form two connecting spaces 13. Two sides of an inner surface of the top wall of the socket connector 1 are recessed inward to form the two connecting spaces 13 spaced from each other. The two connecting spaces 13 are communicated with the insertion space 11. The insertion space 11 of the socket connector 1 is equipped with a plurality of contact pins 14. The plurality of the contact pins 14 are configured to be soldered to a printed circuit board (PCB) by use of any suitable technology. Specifically, the plurality of the contact pins 14 are configured to be soldered to the printed circuit board by use of a surface-mounted device (SMD) technology, a pin in paste (PiP) solder technology, or etc.

With reference to FIG. 2, the plug connector with connector position assurance element 2 includes an insulating body 21, a plurality of terminals 22, a plurality of cables 23 and a connector position assurance (CPA) element 24.

Figure 3:
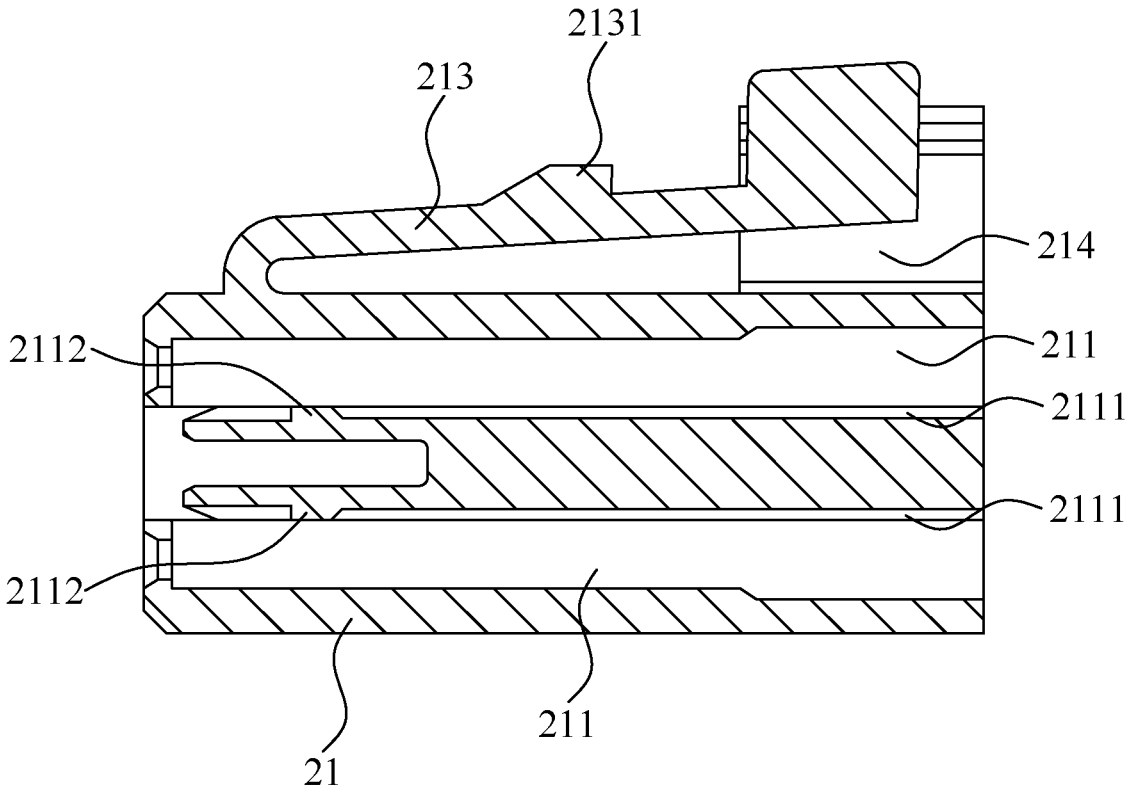
FIG. 3 is a sectional view of the plug connector with connector position assurance element along a line III-III of FIG. 2.
Figure 4:
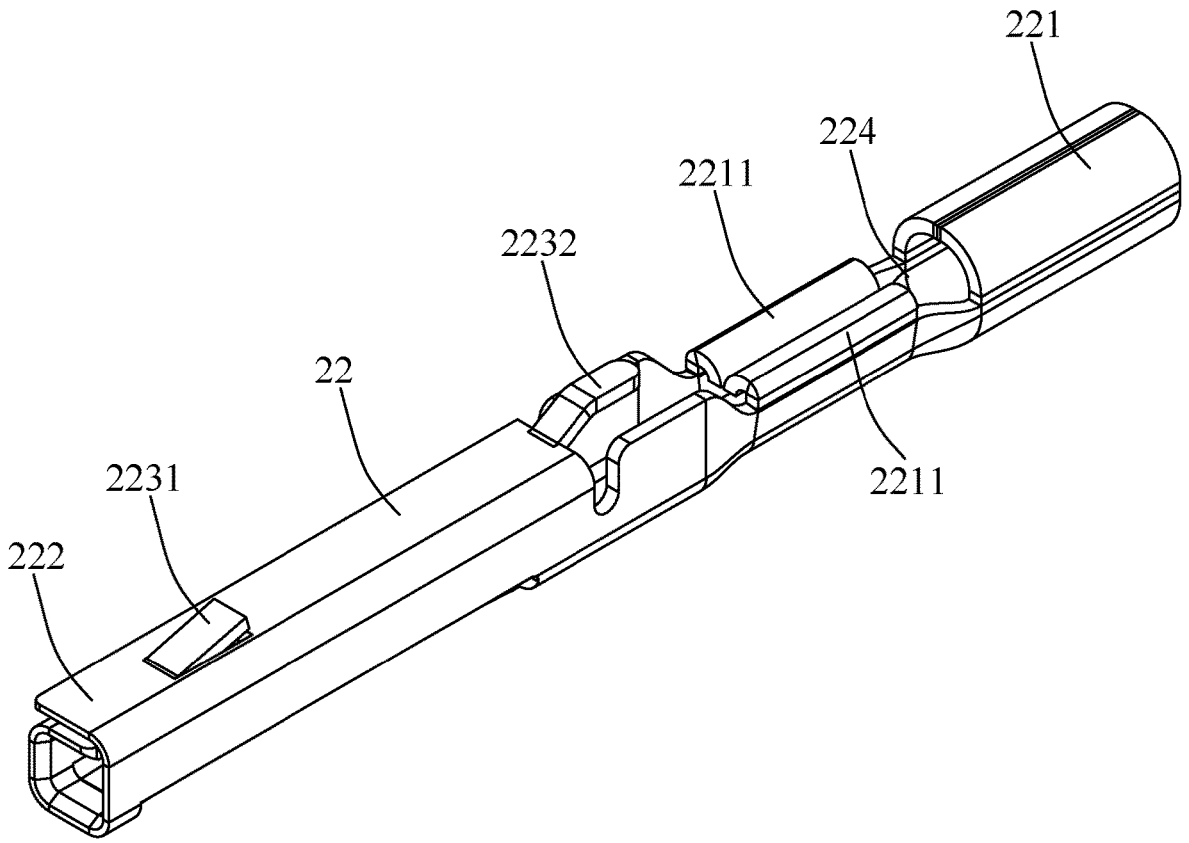
FIG. 4 is a perspective view of a terminal of the plug connector with connector position assurance element of FIG. 1.

With reference to FIG. 2 and FIG. 3, the insulating body 21 defines a plurality of terminal slots 211 longitudinally penetrating through the insulating body 21. In this preferred embodiment, the plurality of the terminal slots 211 are arranged in an upper row and a lower row. The plurality of the terminal slots 211 are recessed inward to form a plurality of positioning slots 2111. The plurality of the positioning slots 2111 are arranged in an upper row and a lower row. Inner walls of the plurality of the positioning slots 2111 away from the plurality of the terminal slots 211 protrude along the up-down direction to form a plurality of limiting blocks 2112 projecting into the plurality of the positioning slots 2111. The upper row of the positioning slots 2111 connected with the upper row of the plurality of terminal slots 211 are opposite to the lower row of the positioning slots 2111 connected with the lower row of the plurality of the terminal slots 211. At least one side of an upper surface of the insulating body 21 protrudes upward to form at least one protruding block 212. At least one side of the upper surface of the insulating body 21 protrudes upward to form at least one protruding block 212. Two sides of the upper surface of the insulating body 21 protrude upward to form two protruding blocks 212. The two protruding blocks 212 are spaced from each other to form a gap 216 between the two protruding blocks 212. Two top ends of the two protruding blocks 212 are bent towards each other to form two blocking portions 215.

An outer surface of the at least one protruding block 212 protrudes outward to form at least one positioning block 2121. Two outer surfaces of the two protruding blocks 212 oppositely protrude outward to form two positioning blocks 2121. The two outer surfaces of the two protruding blocks 212 oppositely protrude outward to form two stopping blocks 2122. The two stopping blocks 2122 are connected with rears of the two positioning blocks 2121. Two facing surfaces of the two protruding blocks 212 are recessed oppositely to form two insertion grooves 2123. A front of a middle of the upper surface of the insulating body 21 protrudes upward and then is bent rearward to form a buckling portion 213 projecting into the gap 216 between the two protruding blocks 212. A middle of a top surface of buckling portion 213 protrudes upward to form a buckling block 2131. The buckling portion 213 projects to one side of the at least one protruding block 212. The buckling block 2131 is disposed corresponding to the buckling hole 12. The at least one protruding block 212 and the buckling portion 213 are spaced from the upper surface of the insulating body 21 to form a positioning space 214 among the at least one protruding block 212, the buckling portion 213 and the upper surface of the insulating body 21. The two protruding blocks 212 and the buckling portion 213 are spaced from the upper surface of the insulating body 21 to form a positioning space 214 among the two protruding blocks 212, the buckling portion 213 and the upper surface of the insulating body 21.

With reference to FIG. 2, FIG. 3, FIG. 4 and FIG. 13, the plurality of the terminals 22 are assembled in the plurality of the terminal slots 211 of the insulating body 21. Two opposite ends of each terminal 22 have a connecting end 221 and a fitting end 222, respectively. A rear end and a front end of each terminal 22 have the connecting end 221 and the fitting end 222, respectively. The connecting ends 221 of the plurality of the terminals 22 are connected to the plurality of the cables 23. A middle of each terminal 22 has two arc-shaped clamping portions 2211 formed by crimping configurations. A top of the middle of each terminal 22 is opened freely to form an opening 224. Two side walls of the opening 224 are bent towards each other and are further curved downward to form the two semicircular clamping portions 2211. The two clamping portions 2211 of each terminal 22 are extendable along a lengthwise direction of each terminal 22 to provide a larger contacting area between one cable 23 and each terminal 22 that is crimped to and connected with the one cable 23. The fitting end 222 is shown as a hollow shape. The fitting end 222 of each terminal 22 is configured to cooperate with one contact pin 14, in the preferred embodiment, the fitting end 222 of each terminal 22 is formed into a box-shape beam with a front end of the fitting end 222 being opened to receive the one contact pin 14 which is diagrammatically drawn and shown in FIG. 2. Nevertheless, it should be understood that a pattern of the fitting end 222 of each terminal 22 of the plug connector with connector position assurance element 2 according to the present invention is without being limited to use the box-shape beam, other matching contact configurations may also be suitable.

Each terminal 22 further has a first positioning portion 2231 punched upward from a top of the front end of the fitting end 222. In each terminal 22, the first positioning portion 2231 is extended and located between the connecting end 221 and a rear end of the fitting end 222. In each terminal 22, a top of the rear end of the fitting end 222 slantwise extends frontward and upward, and then extends frontward to form a second positioning portion 2232. The second positioning portion 2232 is extended and located between the first positioning portion 2231 and the connecting end 221. The first positioning portion 2231 and the second positioning portion 2232 of each terminal 22 are arranged in one positioning slot 2111. The first positioning portion 2231 of each terminal 22 is blocked by a front end of the limiting block 2112 of the one positioning slot 2111, and the second positioning portion 2232 is arranged away from and located behind the limiting block 2112 of the one positioning slot 2111. The first positioning portion 2231 of each terminal 22 is able to resist against the front end of the limiting block 2112 of the one positioning slot 2111. The first positioning portion 2231 and the second positioning portion 2232 of each terminal 22 maintain each terminal 22 within one terminal slot 211 and the one positioning slot 2111 to be located in a constant expectation position of the one terminal slot 211 and the one positioning slot 2111 for preventing a displacement of each terminal 22. The plurality of the cables 23 are connected to the connecting ends 221 of the plurality of the terminals 22.

Figure 5:
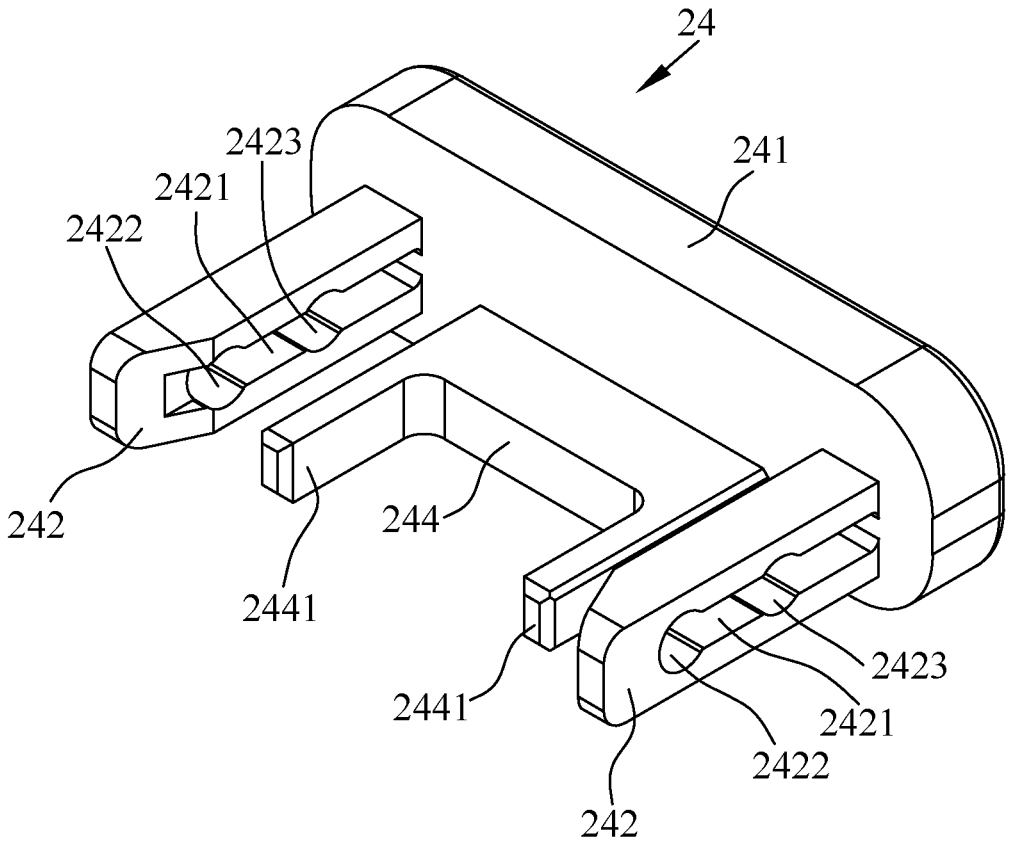
FIG. 5 is a perspective view of a connector position assurance element of the plug connector with connector position assurance element in accordance with the present invention.

With reference to FIG. 2 and FIG. 5, the connector position assurance element 24 is configured to provide a suitable combination between the socket connector 1, and the plug connector with connector position assurance element 2. The connector position assurance element 24 is inserted to a top of the insulating body 21. The connector position assurance element 24 is able to move between a disengagement configuration status and an engagement configuration status. The connector position assurance element 24 has a base portion 241. At least one side of a front surface of the base portion 241 protrudes frontward to form at least one sliding portion 242. A middle of the at least one sliding portion 242 defines at least one sliding channel 2421 longitudinally extending and transversely penetrating through the middle of the at least one sliding portion 242. The at least one sliding channel 2421 has at least one first positioning hole 2422 and at least one second positioning hole 2423. A front end of the at least one sliding channel 2421 expands outward to form at least one first positioning hole 2422. A top and a bottom of a middle of the at least one sliding channel 2421 expand outward to form at least one second positioning hole 2423. A middle of the front surface of the base portion 241 extends frontward to form an abutting block 244 located adjacent to one side of the at least one sliding portion 242. Two sides of the front surface of the base portion 241 protrude frontward to form two sliding portions 242. Middles of the two sliding portions 242 define two sliding channels 2421 longitudinally extending and transversely penetrating through the middles of the two sliding portions 242. Each sliding channel 2421 has a first positioning hole 2422 and a second positioning hole 2423. In each sliding channel 2421, the first positioning hole 2422 is provided at a front end of the sliding channel 2421, and the second positioning hole 2423 is provided between the first positioning hole 2422 and the base portion 241. The front end of each sliding channel 2421 expands outward to form the first positioning hole 2422. A top and a bottom of a middle of each sliding channel 2421 expand outward to form the second positioning hole 2423.

The middle of the front surface of the base portion 241 extends frontward to form the abutting block 244 located between the two sliding portions 242. The abutting block 244 is disposed corresponding to the positioning space 214. Two sides of a front surface of the abutting block 244 further protrude frontward to form two insertion blocks 2441.

The connector position assurance element 24 is assembled to the two protruding blocks 212, and the connector position assurance element 24 is able to slide frontward and rearward along the two protruding blocks 212. When the connector position assurance element 24 is in the disengagement configuration status, the two positioning blocks 2121 are located to the two first positioning holes 2422 of the two sliding portions 242. When the connector position assurance element 24 is in the engagement configuration status, the two positioning blocks 2121 are located to the two second positioning holes 2423 of the two sliding portions 242. The two stopping blocks 2122 are located in the two sliding channels 2421 of the two sliding portions 242 to keep the two sliding channels 2421 moving along the outer surfaces of the two protruding blocks 212 and along a constant track, so that the connector position assurance element 24 along with a movement of the two sliding portions 242 and the two sliding channels 2421 is able to be stably switched between the disengagement configuration status and the engagement configuration status.

Figure 6:
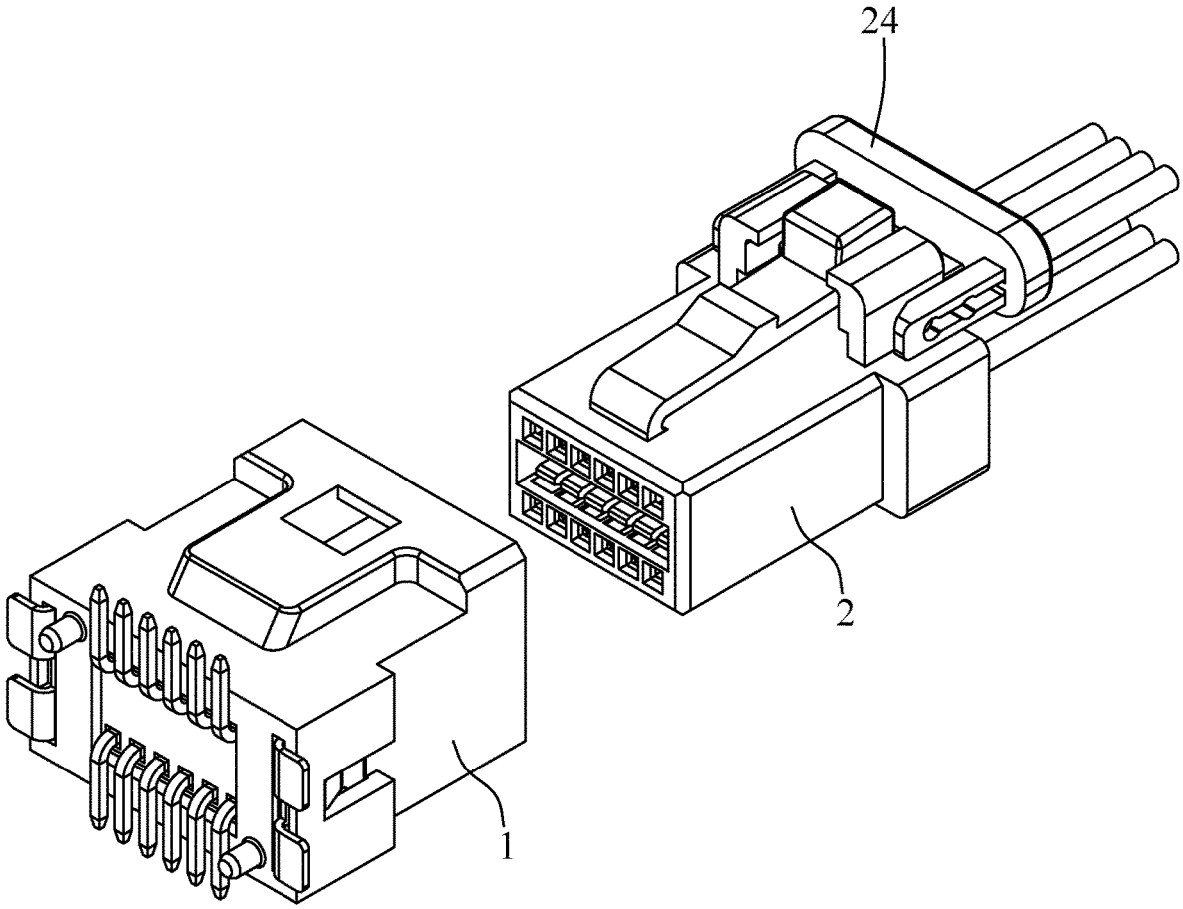
FIG. 6 is a perspective view of the plug connector with connector position assurance element in accordance with the present invention, wherein the plug connector with connector position assurance element is disengaged with the socket connector.
Figure 7:
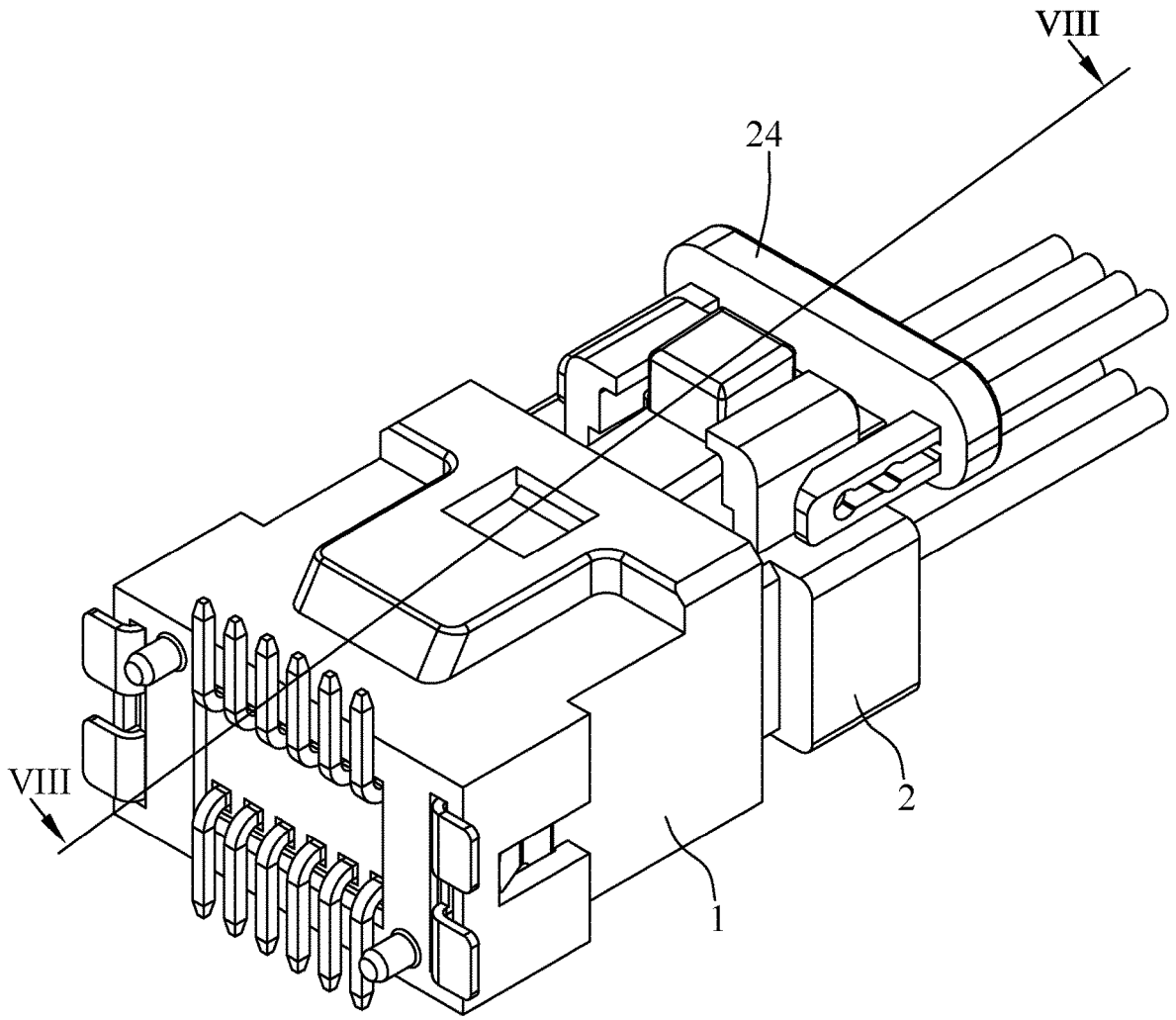
FIG. 7 is a perspective view of the plug connector with connector position assurance element in accordance with the present invention, wherein the plug connector with connector position assurance element is assembled with the socket connector.
Figure 8:
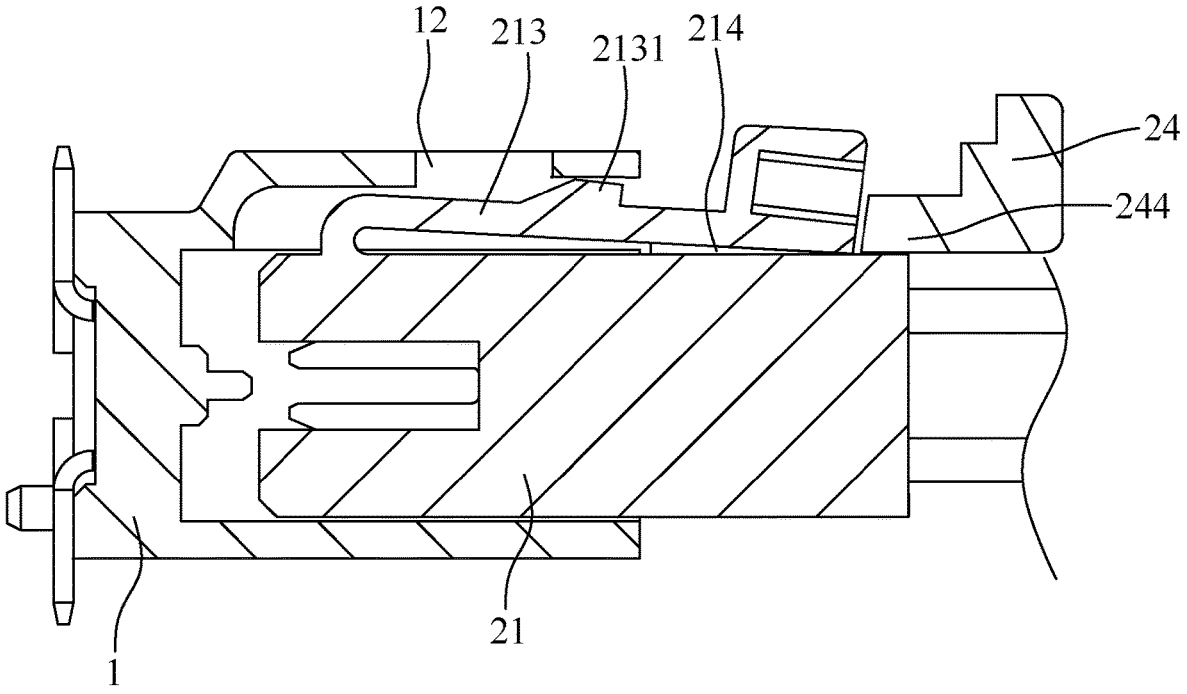
FIG. 8 is a sectional view showing the socket connector and the plug connector with connector position assurance element along a line VIII-VIII of FIG. 7.
Figure 9:
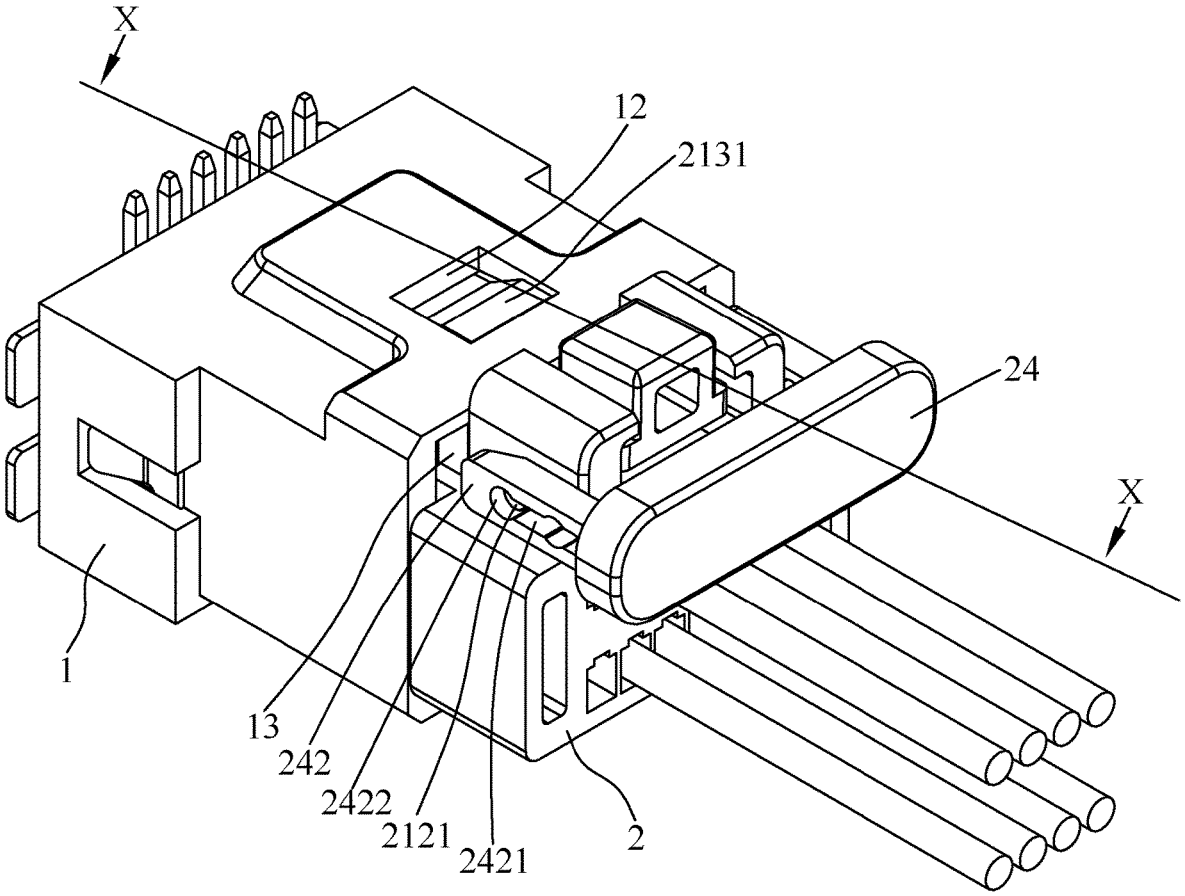
FIG. 9 is a perspective view of the plug connector with connector position assurance element in accordance with the present invention, wherein the plug connector with connector position assurance element is engaged with the socket connector.
Figure 10:
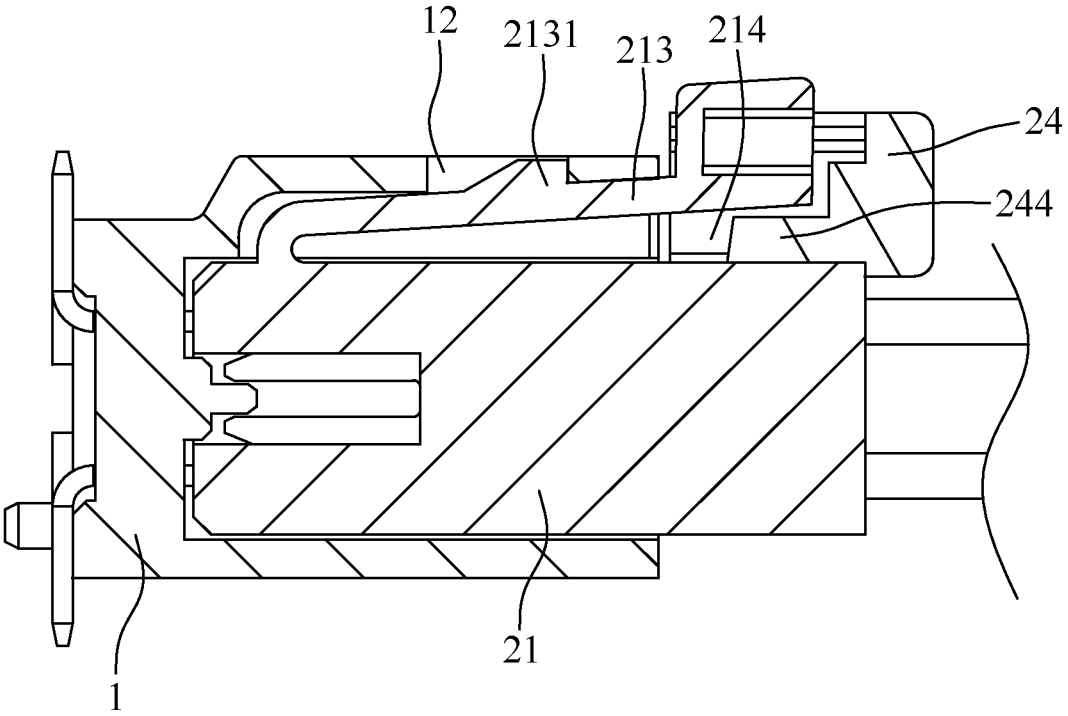
FIG. 10 is a sectional view showing the socket connector and the plug connector with connector position assurance element along a line X-X of FIG. 9.
Figure 11:
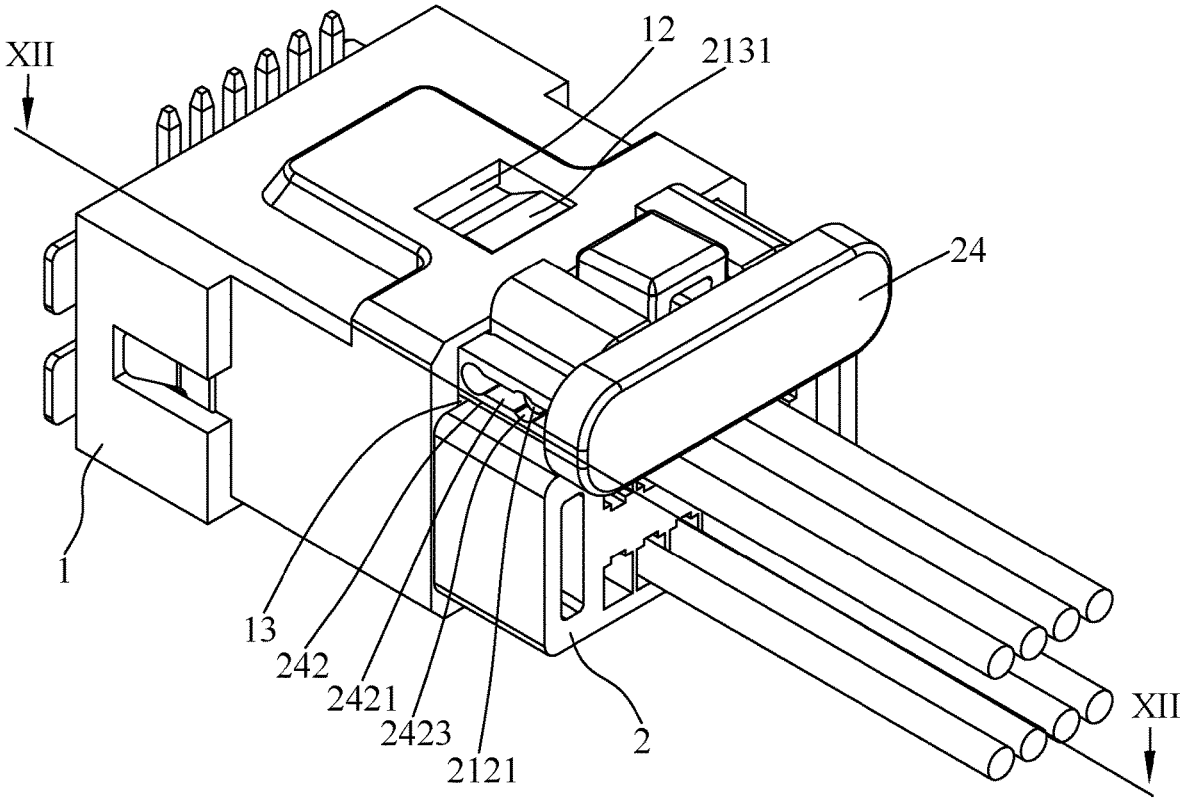
FIG. 11 is a perspective view of the plug connector with connector position assurance element in accordance with the present invention, wherein the connector position assurance element is connected with the socket connector and the plug connector with connector position assurance element.
Figure 12:
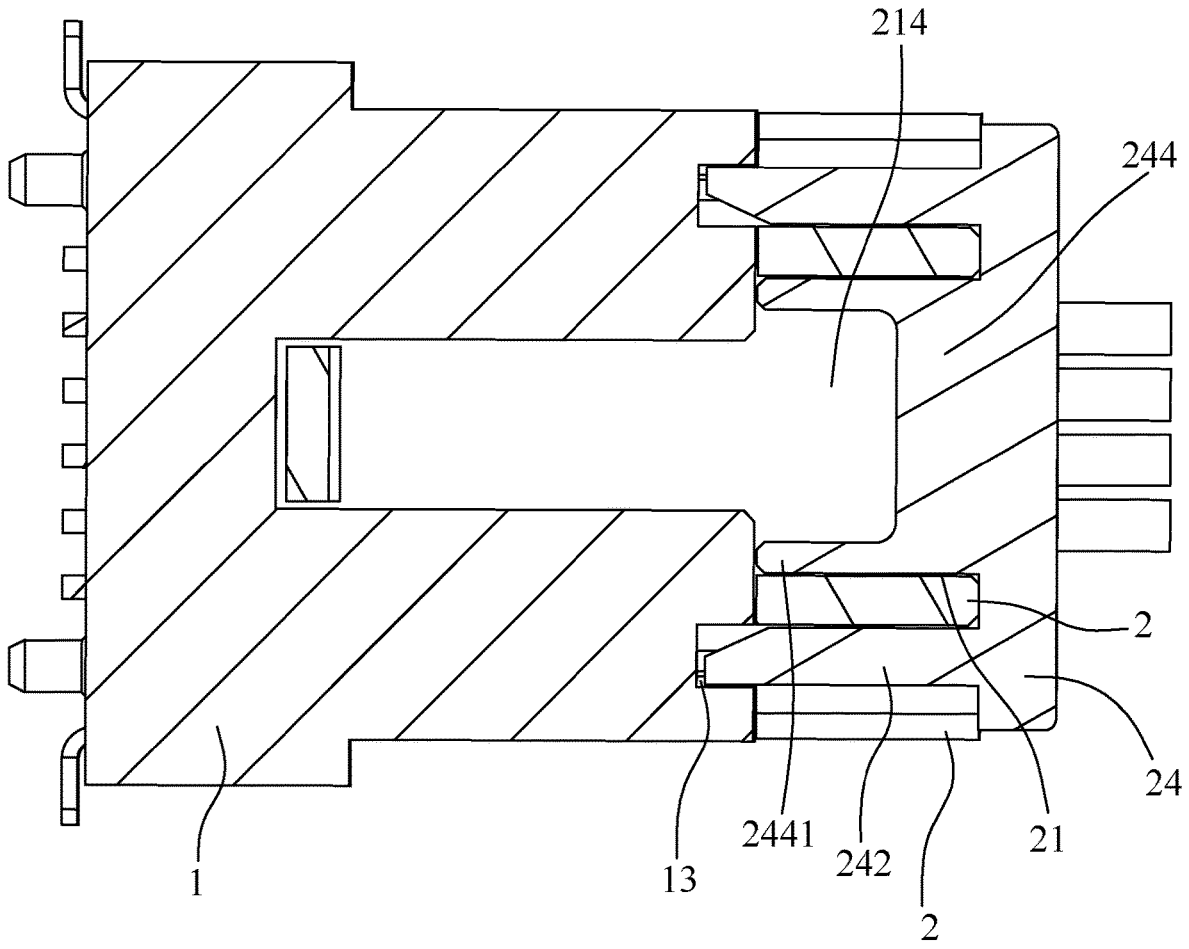
FIG. 12 is a sectional view showing the socket connector and the plug connector with connector position assurance element along a line XII-XII of FIG. 11.
Figure 13:
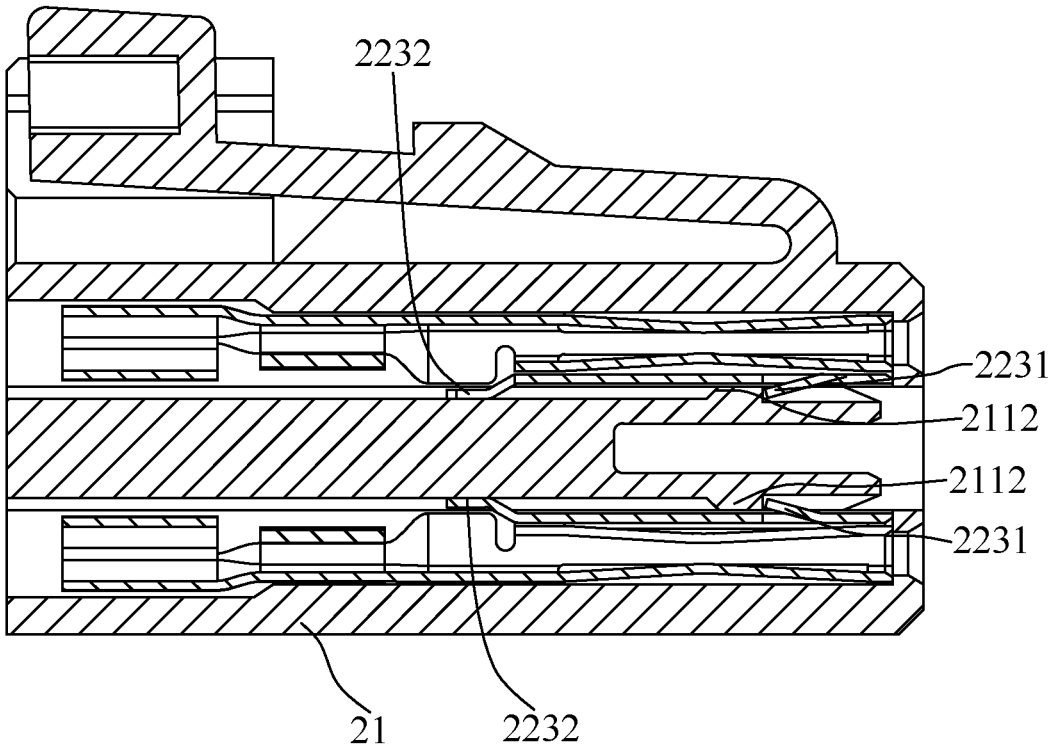
FIG. 13 is a partially sectional view of the plug connector with connector position assurance element in accordance with the present invention.

With reference to FIG. 2, FIG. 5 and FIG. 6, when the socket connector 1 and the plug connector with connector position assurance element 2 are disengaged, and connector position assurance element 24 is located in the disengagement configuration status. The at least one positioning block 2121 is positioned in the at least one first positioning hole 2422 of the at least one sliding portion 242. The two positioning blocks 2121 are positioned in the two first positioning holes 2422 of the two sliding portions 242, so that the connector position assurance element 24 is disposed to the plug connector with connector position assurance element 2. At the same time, the abutting block 244 of the connector position assurance element 24 is without entering the positioning space 214.

With reference to FIG. 7 to FIG. 11, the socket connector 1 and the plug connector with connector position assurance element 2 are partially engaged and are shown from FIG. 7 to FIG. 11, and connector position assurance element 24 is in the disengagement configuration status and is shown from FIG. 7 to FIG. 11. When the plug connector with connector position assurance element 2 is inserted into the insertion space 11 of the socket connector 1, a front end of the buckling portion 213 contacts a top wall of the insertion space 11 in advance. When the plug connector with connector position assurance element 2 continues entering the insertion space 11, the buckling portion 213 is pressed and restricted by the top wall of the insertion space 11 to move downward, so that the positioning space 214 is compressed, at the moment, the abutting block 244 of the connector position assurance element 24 is without entering the positioning space 214, so a downward displacement of the buckling portion 213 will be unaffected to make the plug connector with connector position assurance element 2 be able to continue entering the insertion space 11. In the end, the plurality of the contact pins 14 of the socket connector 1 are in contact with the plurality of the terminals 22 of the plug connector with connector position assurance element 2, and the buckling block 2131 is buckled into the buckling hole 12, at the moment, the buckling portion 213 will return upward to an initial position and is exposed to the positioning space 214, so that a connection between the plug connector with connector position assurance element 2 and the socket connector 1 is completed.

With reference to FIG. 2 to FIG. 12, finally, the connector position assurance element 24 is pushed forward. The at least one first positioning hole 2422 of the at least one sliding portion 242 breaks away from the at least one positioning block 2121 in advance, so the connector position assurance element 24 is able to move frontward by virtue of the at least one sliding channel 2421 of the at least one sliding portion 242 passing frontward through the at least one positioning block 2121, and the connector position assurance element 24 is switched to buckle the at least one positioning block 2121 in the at least one second positioning hole 2423 of the at least one sliding portion 242. The two first positioning holes 2422 of the two sliding portions 242 break away from the two positioning blocks 2121 in advance, so the connector position assurance element 24 is able to move frontward by virtue of the two sliding channels 2421 of the two sliding portions 242 passing frontward through the two positioning blocks 2121 , and the connector position assurance element 24 is switched to buckle the two positioning blocks 2121 in the two second positioning holes 2423 of the two sliding portions 242, at the same time, the abutting block 244 enters the positioning space 214 and abuts upward against the buckling portion 213, so the positioning space 214 is filled up to make the buckling portion 213 have no way of being pressed downward. Simultaneously, a front end of the at least one sliding portion 242 enters the at least one connecting space 13. Front ends of the two sliding portions 242 enter the two connecting spaces 13 of the socket connector 1. The two insertion blocks 2441 are inserted into the two insertion grooves 2123 of the plug connector with connector position assurance element 2. In this way, a contact area among the connector position assurance element 24, the socket connector 1 and the plug connector with connector position assurance element 2 is increased to increase a mutual friction force among the connector position assurance element 24, the socket connector 1 and the plug connector with connector position assurance element 2, so that the connector position assurance element 24 is hardly loosened from the socket connector 1 and the plug connector with connector position assurance element 2, and then a plug-in status between the plug connector with connector position assurance element 2, and the socket connector 1 is maintained, correspondingly, an insertion and connection status between the plug connector with connector position assurance element 2 and the socket connector 1 is kept.

With reference to FIG. 2 to FIG. 13, when the plug connector with connector position assurance element 2 is to be withdrawn from the socket connector 1 by a user, firstly the connector position assurance element 24 is pulled rearward, and the connector position assurance element 24 is switched to the disengagement configuration status. The front ends of the two sliding portions 242 are separated from the two connecting spaces 13 of the socket connector 1. The two insertion blocks 2441 are receded from the two insertion grooves 2123 of the plug connector with connector position assurance element 2, and the abutting block 244 is receded from the positioning space 214. In this way, the buckling portion 213 moves downward, so that the buckling block 2131 be able to move downward to break away from the buckling hole 12, and the buckling portion 213 is able to be receded rearward from the insertion space 11. The plurality of the terminals 22 are separated from the plurality of the contact pins 14, so that the plug connector with connector position assurance element 2 is withdrawn from the socket connector 1.

As described above, the abutting block 244 abuts against the buckling portion 213 by virtue of the connector position assurance element 24 to maintain the plug-in status between the socket connector 1 and the plug connector with connector position assurance element 2.

What is claimed is:

1. A plug connector with a connector position assurance element inserted into and cooperated with a socket connector, two sides of a surface of the socket connector being recessed inward to form two connecting spaces, the plug connector with connector position assurance element comprising:

an insulating body, the insulating body defining a plurality of terminal slots longitudinally penetrating through the insulating body, two sides of an upper surface of the insulating body protruding upward to form two protruding blocks spaced from each other, two outer surfaces of the two protruding blocks oppositely protruding outward to form two positioning blocks, the upper surface of the insulating body protruding upward and then being bent rearward to form a buckling portion projecting into a gap between the two protruding blocks, the two protruding blocks and the buckling portion being spaced from the upper surface of the insulating body to form a positioning space among the two protruding blocks, the buckling portion and the upper surface of the insulating body;

a plurality of terminals assembled in the plurality of the terminal slots, two opposite ends of each terminal having a connecting end and a fitting end;

a plurality of cables, the connecting ends of the plurality of the terminals being connected to the plurality of the cables; and a connector position assurance element inserted to a top of the insulating body, the connector position assurance element having a base portion, two sides of a front surface of the base portion protruding frontward to form two sliding portions, middles of the two sliding portions defining two sliding channels longitudinally extending and transversely penetrating through the middles of the two sliding portions, each sliding channel having a first positioning hole and a second positioning hole, a middle of the front surface of the base portion extending frontward to form an abutting block located between the two sliding portions, the abutting block being disposed corresponding to the positioning space, when the socket connector and the plug connector with connector position assurance element are disengaged, the two positioning blocks being positioned in the two first positioning holes of the two sliding portions, the abutting block being without entering the positioning space, when the plug connector with connector position assurance element is inserted into the socket connector, the connector position assurance element being pushed forward, the two first positioning holes of the two sliding portions breaking away from the two positioning blocks in advance, so the connector position assurance element being able to move frontward by virtue of two sliding channels of the two sliding portions passing frontward through the two positioning blocks, and the connector position assurance element being switched to buckle the two positioning blocks in the two second positioning holes of the two sliding portions, at the same time, the abutting block entering the positioning space and abutting upward against the buckling portion, so the positioning space being filled up to make the buckling portion have no way of being pressed down, front ends of the two sliding portions entering the two connecting spaces, and then a plug-in status between the plug connector with connector position assurance element, and the socket connector being maintained.

2. The plug connector with a connector position assurance element as claimed in claim 1, wherein the two outer surfaces of the two protruding blocks oppositely protrude outward to form two stopping blocks, the two stopping blocks are located in the two sliding channels of the two sliding portions.

3. The plug connector with a connector position assurance element as claimed in claim 1, wherein two facing surfaces of the two protruding blocks are recessed oppositely to form two insertion grooves, two sides of a front surface of the abutting block further protrude frontward to form two insertion blocks, when the plug connector with connector position assurance element is inserted into the socket connector, the abutting block enters the positioning space, the two insertion blocks are inserted into the two insertion grooves.

4. The plug connector with a connector position assurance element as claimed in claim 1, wherein the plurality of the terminal slots are arranged in an upper row and a lower row.

5. The plug connector with a connector position assurance element as claimed in claim 4, wherein the plurality of the terminal slots are recessed inward to form a plurality of positioning slots, the plurality of the positioning slots are arranged in an upper row and a lower row, the upper row of the positioning slots connected with the upper row of the plurality of terminal slots are opposite to the lower row of the positioning slots connected with the lower row of the plurality of the terminal slots.

6. The plug connector with a connector position assurance element as claimed in claim 1, wherein the socket connector defines an insertion space penetrating through a rear surface of the socket connector, a middle of a top surface of buckling portion protrudes upward to form a buckling block, the buckling block is disposed corresponding to the buckling hole.

7. The plug connector with a connector position assurance element as claimed in claim 1, wherein a middle of each terminal has two clamping portions formed by crimping configurations.

8. The plug connector with a connector position assurance element as claimed in claim 7, wherein the two clamping portions of each terminal are extendable along a lengthwise direction of each terminal to provide a larger contacting area between one cable and each terminal.

9. The plug connector with a connector position assurance element as claimed in claim 1, wherein each terminal has a first positioning portion punched upward from a top of a front end of the fitting end, in each terminal, the first positioning portion is extended and located between the connecting end and a rear end of the fitting end, a top of the rear end of the fitting end slantwise extends frontward and upward, and then extends frontward to form a second positioning portion, the second positioning portion is extended and located between the first positioning portion and the connecting end.

10. The plug connector with a connector position assurance element as claimed in claim 9, wherein the plurality of the terminal slots are recessed inward to form a plurality of positioning slots, inner walls of the plurality of the positioning slots away from the plurality of the terminal slots protrude along an up-down direction to form a plurality of limiting blocks projecting into the plurality of the positioning slots, the first positioning portion and the second positioning portion of each terminal are arranged in one positioning slot, the first positioning portion of each terminal is blocked by a front end of the limiting block of the one positioning slot, and the second positioning portion is arranged away from and located behind the limiting block of the one positioning slot.

11. The plug connector with a connector position assurance element as claimed in claim 1, wherein in each sliding channel, a front end of each sliding channel expands outward to form the first positioning hole, a top and a bottom of a middle of each sliding channel expand outward to form the second positioning hole, and the second positioning hole is provided between the first positioning hole and the base portion.

12. A plug connector with a connector position assurance element inserted into and cooperated with a socket connector, at least one side of a surface of the socket connector being recessed inward to form at least one connecting space, the plug connector with connector position assurance element comprising:

an insulating body, at least one side of an upper surface of the insulating body protruding upward to form at least one protruding block, an outer surface of the at least one protruding block protruding outward to form at least one positioning block, the upper surface of the insulating body protruding upward and then being bent rearward to form a buckling portion projecting to one side of the at least one protruding block, the at least one protruding block and the buckling portion being spaced from the upper surface of the insulating body to form a positioning space among the at least one protruding block, the buckling portion and the upper surface of the insulating body;

a plurality of terminals assembled in the insulating body; and a connector position assurance element inserted to a top of the insulating body, the connector position assurance element having a base portion, at least one side of a front surface of the base portion protruding frontward to form at least one sliding portion, a middle of the at least one sliding portion defining at least one sliding channel longitudinally extending and transversely penetrating through the middle of the at least one sliding portion, a front end of the at least one sliding channel expanding outward to form at least one first positioning hole, a top and a bottom of a middle of the at least one sliding channel expanding outward to form at least one second positioning hole, a middle of the front surface of the base portion extending frontward to form an abutting block located adjacent to one side of the at least one sliding portion, the abutting block being disposed corresponding to the positioning space, when the socket connector and the plug connector with connector position assurance element are disengaged, the at least one positioning block being positioned in the at least one first positioning hole of the at least one sliding portion, the abutting block being without entering the positioning space, when the plug connector with connector position assurance element is inserted into the socket connector, the connector position assurance element being pushed forward, the at least one first positioning hole of the at least one sliding portion breaking away from the at least one positioning block in advance, so the connector position assurance element being able to move frontward by virtue of the at least one sliding channel of the at least one sliding portion passing frontward through the at least one positioning block, and the connector position assurance element being switched to buckle the at least one positioning block in the at least one second positioning hole of the at least one sliding portion, at the same time, the abutting block entering the positioning space and abutting upward against the buckling portion, so the positioning space being filled up to make the buckling portion have no way of being pressed down, a front end of the at least one sliding portion entering the at least one connecting space, and then a plug-in status between the plug connector with connector position assurance element, and the socket connector being maintained.

13. A connector assembly, comprising:

a socket connector, two sides of an inner surface of a top wall of the socket connector being recessed inward to form two connecting spaces spaced from each other; and a plug connector with connector position assurance element inserted into the socket connector, including:

an insulating body, the insulating body defining a plurality of terminal slots longitudinally penetrating through the insulating body, two sides of an upper surface of the insulating body protruding upward to form two protruding blocks spaced from each other, two outer surfaces of the two protruding blocks oppositely protruding outward to form two positioning blocks, the upper surface of the insulating body protruding upward and then being bent rearward to form a buckling portion projecting into a gap between the two protruding blocks, the two protruding blocks and the buckling portion being spaced from the upper surface of the insulating body to form a positioning space among the two protruding blocks, the buckling portion and the upper surface of the insulating body;

a plurality of terminals assembled in the plurality of the terminal slots, two opposite ends of each terminal having a connecting end and a fitting end;

a plurality of cables, the connecting ends of the plurality of the terminals being connected to the plurality of the cables; and a connector position assurance element inserted to a top of the insulating body, the connector position assurance element having a base portion, two sides of a front surface of the base portion protruding frontward to form two sliding portions, middles of the two sliding portions defining two sliding channels longitudinally extending and transversely penetrating through the middles of the two sliding portions, each sliding channel having a first positioning hole and a second positioning hole, a middle of the front surface of the base portion extending frontward to form an abutting block located between the two sliding portions, the abutting block being disposed corresponding to the positioning space, when the socket connector and the plug connector with connector position assurance element are disengaged, the two positioning blocks being positioned in the two first positioning holes of the two sliding portions, the abutting block being without entering the positioning space, when the plug connector with connector position assurance element is inserted into the socket connector, the connector position assurance element being pushed forward, the two first positioning holes of the two sliding portions breaking away from the two positioning blocks in advance, so the connector position assurance element being able to move frontward by virtue of two sliding channels of the two sliding portions passing frontward through the two positioning blocks, and the connector position assurance element being switched to buckle the two positioning blocks in the two second positioning holes of the two sliding portions, at the same time, the abutting block entering the positioning space and abutting upward against the buckling portion, so the positioning space being filled up to make the buckling portion have no way of being pressed down, front ends of the two sliding portions entering the two connecting spaces, and then a plug-in status between the plug connector with connector position assurance element, and the socket connector being maintained.

14. The connector assembly as claimed in claim 13, wherein each terminal has a first positioning portion punched upward from a top of a front end of the fitting end, in each terminal, a top of a rear end of the fitting end slantwise extends frontward and upward, and then extends frontward to form a second positioning portion, the plurality of the terminal slots are recessed inward to form a plurality of positioning slots, inner walls of the plurality of the positioning slots away from the plurality of the terminal slots protrude along an up-down direction to form a plurality of limiting blocks projecting into the plurality of the positioning slots, the first positioning portion and the second positioning portion of each terminal are arranged in one positioning slot, the first positioning portion of each terminal is blocked by a front end of the limiting block of the one positioning slot, and the second positioning portion is arranged away from and located behind the limiting block of the one positioning slot.

15. The connector assembly as claimed in claim 13, wherein in each sliding channel, the first positioning hole is provided at a front end of the sliding channel, and the second positioning hole is provided between the first positioning hole and the base portion.

16. The connector assembly as claimed in claim 13, wherein the two outer surfaces of the two protruding blocks oppositely protrude outward to form two stopping blocks, the two stopping blocks are located in the two sliding channels of the two sliding portions.

17. The connector assembly as claimed in claim 13, wherein two facing surfaces of the two protruding blocks are recessed oppositely to form two insertion grooves, two sides of a front surface of the abutting block further protrude frontward to form two insertion blocks, when the plug connector with connector position assurance element is inserted into the socket connector, the abutting block enters the positioning space, the two insertion blocks are inserted into the two insertion grooves.

18. The connector assembly as claimed in claim 13, wherein the plurality of the terminal slots are arranged in an upper row and a lower row.

19. The connector assembly as claimed in claim 18, wherein the plurality of the terminal slots are recessed inward to form a plurality of positioning slots, the plurality of the positioning slots are arranged in an upper row and a lower row, the upper row of the positioning slots connected with the upper row of the plurality of terminal slots are opposite to the lower row of the positioning slots connected with the lower row of the plurality of the terminal slots.

20. The connector assembly as claimed in claim 13, wherein the socket connector defines an insertion space penetrating through a rear surface of the socket connector, a middle of a top surface of buckling portion protrudes upward to form a buckling block, the buckling block is disposed corresponding to the buckling hole.

* * * * *